United States Patent [19]

Zeringue, Jr.

[11] Patent Number: 4,643,259

[45] Date of Patent: Feb. 17, 1987

[54] HYDRAULIC DRILL STRING BREAKDOWN AND BLEED OFF UNIT

[75] Inventor: Freddie J. Zeringue, Jr., Houma, La.

[73] Assignee: Autobust, Inc., Thibodaux, La.

[21] Appl. No.: 657,623

[22] Filed: Oct. 4, 1984

[51] Int. Cl.[4] ..... E21B 19/16; B25B 17/00

[52] U.S. Cl. ..... 166/77.5; 166/78; 166/85; 81/57.16; 81/57.34; 173/164

[58] Field of Search ..... 166/77.5, 78, 85, 379, 166/380; 175/52, 85; 173/164; 81/57.16, 57.34

[56] References Cited

U.S. PATENT DOCUMENTS 4,162,704 7/1979 Gunther ..... 166/77.5

*Primary Examiner*—Stuart S. Levy
*Assistant Examiner*—David Werner
*Attorney, Agent, or Firm*—Keaty & Keaty

[57] ABSTRACT

A combination tool for breakdown of oilwell drill strings which may contain obstructions, corrosive fluids, and trapped, high-pressure gases is disclosed. The tool provides an upper rotary hydraulic power wrench or tong, an intermediate, hydraulically operated pressure chamber for enclosing the drill string joint during the breakdown process, and a lower backup tong for securing a section of the drill string against the rotary effort of the upper tong. The combination is mounted on a drill platform to be rolled from a position free of the drill string and rotary table to a position over the rotary table encompassing a joint in the drill string to be broken down. Chicksan lines connect the pressure chamber of the tool to a support base permitting the controlled bleedoff of trapped pressure. Two supplementary high-pressure lines connected by chicksan lines to a backup structure permit controlled bleeding off of drilling fluids trapped in a section of drill string and permit fluid flow to wash away entrapped particulates released when the drill string is broken down. The pressure chamber contains a set of anti-kick jaws to prevent the ejection of the removed drill string section in the event of sudden release of trapped gas. A set of gears and splines coordinate the rotation of the anti-kick jaws and the power tong jaws, and maintain power tong jaws at a right angle with respect to the upper drill string segment during vertical motion of the drill string.

11 Claims, 4 Drawing Figures

HYDRAULIC DRILL STRING BREAKDOWN AND BLEED OFF UNIT

BACKGROUND OF THE INVENTION

Within the field of oilwell drilling, it has been known to use powered hydraulic wrenches or tongs to fasten and unfasten threaded sections of drillstring pipe during the process of removal or reinsertion of drillpipe into a bore hole for drilling. The usual practice involves operations on the working platform of an oilwell rig or a drilling rig in which a continuous pipestring or drillstring made up of threaded segments of pipe extends down through a bore hole and is rotated to drive a drill bit. The individual segments of drillpipe are hollow, and provide a passageway for a drilling fluid, usually a viscous water or oil based fluid known as drilling mud, which both lubricates and aids the cutting of a drill bit and flushes the cut particles from the bore hole.

The entire drillstring is rotated for drilling by means of a powered rotary table and an associated tool, known as a kelly, for imparting the rotary motion of the table to the drillstring. When it is necessary to remove the drillstring from the borehole a block and tackle is used to raise the kelly, removing the drillstring from the borehole a distance sufficient to expose at least one threaded section of pipe of which the drillstring is made up.

The drillstring is broken down by unthreading or unscrewing these pipe segments, normally by the use of a pair of powered rotary hydraulic wrenches of the type known as hydraulic tongs. In this usage, the tongs, which, because of the torques involved, are relatively large, heavy articles, are suspended by a counterbalancing mechanism within the drill rig adjacent to the rotary table.

A first non-rotating tong called the backup tong, is clamped below a threaded joint onto a section of the drillstring; it serves, in combination with a set of inserted slips within the rotary table which prevent the drillstring from falling into the borehole, to secure a lower section below a threaded joint against rotation. A second rotary power tong is clamped to a section of the drillstring above a threaded joint. The torque applied by the rotary power tongs against the fixed resistance of the lower fixed tong provides adequate force across the threaded joint to unscrew the joint, releasing the upper drillstring segment or pipe section for removal.

After an oilwell has been drilled and placed into production, the produced fluids, under pressure, are transported up a pipe section known as production tubing. The primary physical difference between a string of production tubing and a drillstring is that the production tubing is physically smaller, and is fixed within the drillbore rather than being rotating. Further, production tubing is only removed in the event of a downhole problem requiring access to the formation to increase production or because of a downhole blockage. In this environment, a major problem occurs when the tubing section becomes jammed. There are a number of events which can cause such blocking; but the most common occur when a wireline tool, which is periodically lowered within the tubing to test the downhole formation, for some reason becomes jammed, and when a produced fluid which will usually include sand and particles, for any of a number of reasons, cakes up and forms a solid plug within the tubing.

When this production tubing is pulled it will commonly be found that the length of time that it has remained downhole causes chemical changes and corrosion to the threaded joints of each of the tubing sections and that significant torque is required to break the tubing apart.

Since downhole pressures can be extremely high in downhole production operations, and since it is typical to encounter various gasses entrapped within downhole fluids, such a blockage can create a dangerous situation within the production tubing. Some sections of the tubing between blockages can contain trapped fluids and gasses at relatively high pressures. When the tubing is uncoupled as described above these pressures react against the threaded joint, causing a sudden rupture of the joint as it is unscrewed and a dangerous expulsion of liquids and particles at a level of the drill floor which is occupied by working personnel. In addition, the sudden release of pressure can propel the upper tubing section, which is restrained only by the draw works, within the rig creating a special hazard to personnel and equipment.

Even where no pressure release is involved, the existence of trapped sections within a drillstring can result in the loss of significant amounts of valuable drilling fluids. The drillstring is broken apart above the drill floor, well removed from the normal provisions for capturing the flow of drilling fluid and recovering the fluids. Some drilling fluids such as calcium bromide are extremely expensive and represent a significant monetary value if lost or contaminated.

In the current art there is no known reliable method for preventing the sudden release of entrapped gasses or the loss of valuable trapped fluids within a pipestring containing internal blockage.

SUMMARY OF THE INVENTION

The current invention is a combination tool which both provides the rotary forces to engage and break apart a drillstring or length of tubing into segments as well as providing a capability of containing the sudden release of pressurized fluid or recovering substantially all trapped fluids within a drillstring or tubing segment.

The invention comprises, in combination, an upper rotary power wrench or tong; a set of specialized "anti-kick" slip jaws designed to rotate in synchronization with the upper tong and to secure an upper section of pipe against sudden vertical motion in the event of a pressure release or kick; a pressure chamber, of unique design, which, in conjunction with the upper power tong encloses and secures the threaded joint of the drillstring during the uncoupling operation preventing both the sudden release of any pressurized gas and recovering any entrapped fluid; a backup tong for securing the lower section of the drillstring against rotation against the torque force of the upper power tong; and a telescoping pressurized line system for permitting the controlled bleedoff of entrapped pressure, the recovery of fluid, and providing a washing capability for removing entrapped particulate contaminants or other matter.

The entire tool is designed as a mobile unit connected to a fixed hardback installation to which the various pressure lines connect for bleeding off the high pressure gas, removing the trapped liquid, and applying the washing medium. The unit is provided with rollers to permit it to be moved under hydraulic power from a stowed position clear of the operating area around the rotary to an operating position where it may be closed, enclosing a pipe joint to be broken down. By means of the synchronized internal gearing and lock mechanisms the single act of closing the unit grips the section of drillstring below the threaded joint in the backup tongs against rotation, grips the section of the drillstring above the threaded joint in both the power tongs and the anti-kick jaws for providing a controlled rotary unscrewing torque, and encloses the threaded joint itself within a pressure chamber, for containing any sudden release of gasses.

A preferred embodiment of the invention includes a unique geared synchronizing mechanism for insuring synchronous rotation of the anti-kick jaws with the power tong jaws and for simultaneously insuring that either a kick or the normal, gradual upward motion of the upper pipe segment being unscrewed is matched with a parallel upward motion of the power tongs, maintaining the power tongs in an optimum, perpendicular relationship to the pipe segment being unscrewed. The preferred embodiment also includes a unique pressure cylinder locking mechanism which overcomes many problems of the prior art in regards to protection against sudden pressure surges, and is notable in that it involves metal braced pressure seals at critical points, preventing any sudden escape of pressure which might occur with the failure of an unbraced rubber or polymer seal.

It is thus an object of this invention to provide an apparatus which may be readily engaged to uncouple and separate segments of pipe making up a drillstring in an oilwell rig.

It is a further object of this invention to provide an apparatus which uncouples segments of pipe within an oilwell drillstring while safely enclosing the separated joint to prevent the escapage of entrapped gasses or pressurized liquids.

It is a further object of this invention to provide a unitized apparatus for uncoupling a series of pipe segments making up an oilwell drillstring while providing a capability to recover valuable drilling fluids that may be entrapped therein.

It is a further object of this invention to provide a unitized, hydraulic device for uncoupling segments of pipe making up an oilwell drillstring while providing a capability for controlled washing away of entrapped particulate contaminants within the oilwell drillstring.

These and other objects of the invention may be more readily seen from the detailed description of the preferred embodiment and the claims which follow.

MATERIAL INFORMATION DISCLOSURE

U.S. Pat. No. 4,406,333 to Adams discloses a rotating head on a rotary drilling rig, showing a normal method in the prior art for draining off drilling fluids from a circulating drillstring. It is to be noted that the overall design of this rotary head is designed for a relatively low pressure return on the drilling fluid, and the disclosure shows the drilling fluids being removed from the annular region between the drillstring and an outer casing at a point somewhat below the kelly. Thus, the particular unit shows the use of rubber seals as the primary pressure sealing method, it involves the use of a rotating head method or passage for rotating pipe, and contains channels for diverting fluid, debris and pressure from the top of the conductor pipe. It is distinguishable in that it does not involve the pressure levels of the current invention, nor is there a necessity for permitting a degree of vertical motion within the pipe within the rotating head while restricting excessive vertical motion nor is there a necessity for both an upper and a lower seal on the pipe.

U.S. Pat. No. 4,321,975 to Dyer discloses a "slurry diverter", which is an alternate mechanism again for diverting the return flow of the drilling fluid circulation to a recovery point. It is noted that the invention specifically is written to a waterwell drill using comparatively low water and air pressure and the inventor clearly distinguishes from the higher pressure environment in the oil well, disclosing a structure that may be used where the pressure differential across the seals is relatively small and when it is permissible to have greater gap tolerances than in an oilwell environment.

U.S. Pat. No. 3,774,697 to Brown shows a typical electric motor drive assembly pivotally supported from a traveling block within an oil rig to handle tubular pipe. This device is primarily a substitute for the existing kelly, rotary table, and power tongs. It consequently, due to its suspension from the traveling block, it has significant upper limits on the total amount of torque that it can provide to a drillstring.

U.S. Pat. No. 3,722,607 to Ray discloses an apparatus for drilling a well by rotating a drillstring having a downhole drill bit in which the conventional derrick and rig are not utilized. The apparatus eliminates the hydraulic power tongs for making up or breaking down a drillstring in the individial drillpipe segments by utilizing the rotary table to also perform the tong functions.

U.S. Pat. No. 4,147,215 to Hodge, et al shows a vertical structure installed over a rotary table, including a powered wrench mechanism for making up and breaking out sections of drillpipe in coordination with the rotary table. The drillpipe must be modified to adapt to the mechanism shown in the patent.

U.S. Pat. No. 3,446,284 to Dyer, et al discloses a unitized device for making up or breaking down a drillstring utilizing both top and bottom slips, a pipe drip system and a motorized drive for the tongs. The specific design of the apparatus is adaptable for only pipe subs of a particular length, which is a function of the overall design of the apparatus, limited in that the apparatus must tilt about a pivot and, therefore, must be restricted in its overall pivoting arc by the exterior oilrig in which it is installed. As a result of the particular construction of this apparatus and the method for removing the individual pipe sections or subs as they are unscrewed, there is no structure disclosed to permit the upper, rotary wrench or tong to be opened to engage circumferentially a pipe section, closing around it.

U.S. Pat. No. 2,883,155 to Gehrke discloses a rotary well drilling device in which the drilling fluids are returned by means of a circulating screw in the annulus between the drillstring and the drill casing through a closed chamber for diversion into a separation trough.

U.S. Pat. No. 4,202,225 to Sheldon, et al discloses, incident to a particular apparatus and control method for controlling tongs, for coordinated use of a power tong and a backup tong to make up or break down a drillstring in conjunction with a tong mechanism and pipe stabber on a platform which is transitioned from a first to a second position to engage a drillstring.

DETAILED DESCRIPTION OF THE PREFERRED EMBODIMENT

Figure 1:
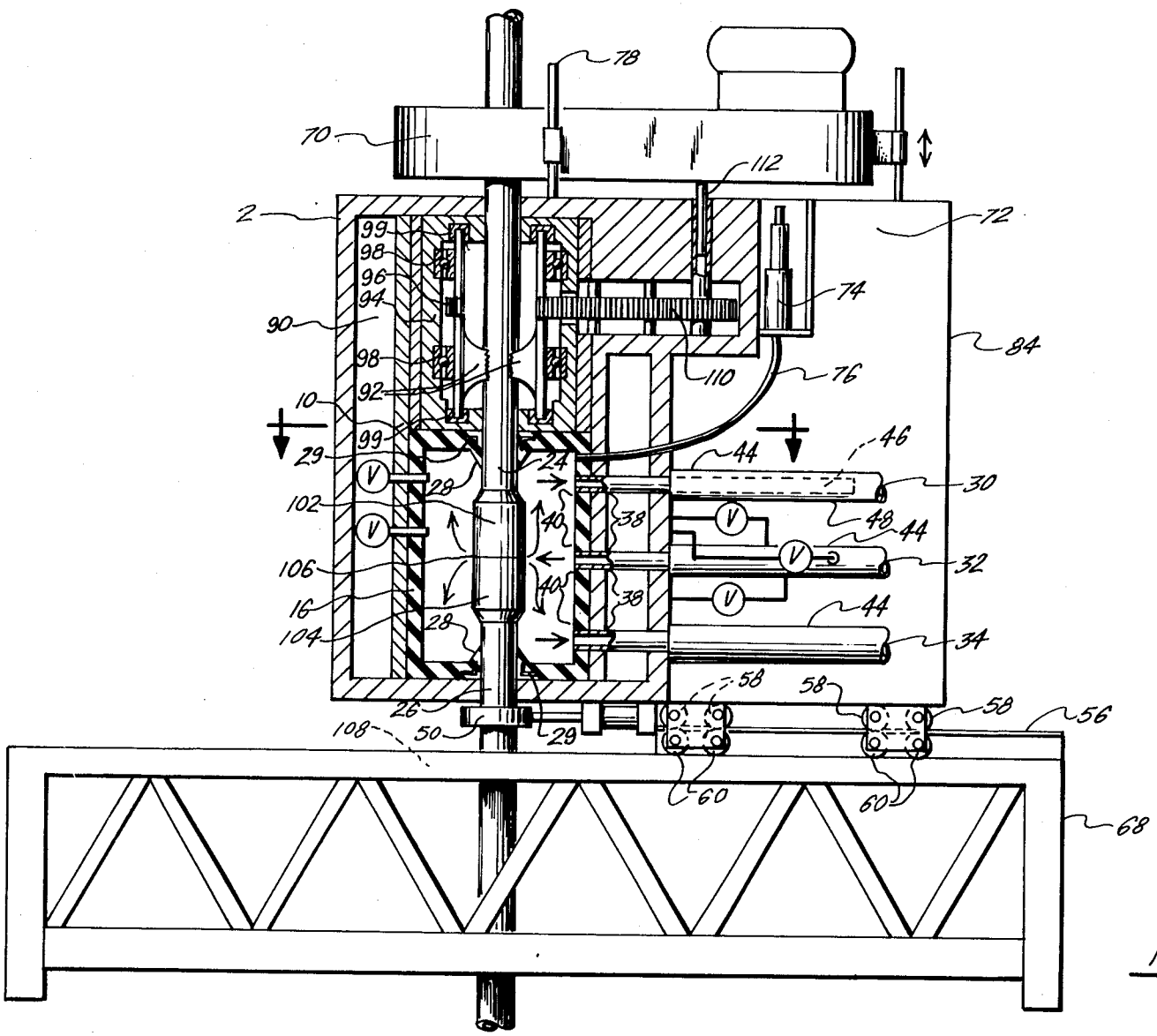
FIG. 1 is a perspective, partially cut-away elevational view of the preferred embodiment of the present invention.

Referring to FIG. 1 the application in its preferred embodiment comprises first a largely cylindrical high pressure container 2 designed to encompass and enclose a drill string joint section. As is known the drill string comprises a repeated group of pipe sections, here upper drill string pipe section 102 and lower drill string pipe section 104, connected by a standard API pin and socket forming together a drill string joint 106.

In order to enclose the drill string joint section, high pressure container 2 (see FIG. 4) has, as major components, a back semi-cylindrical section 4 and two front opening, quarter shell sections 6*a* and 6*b*, pivoting for opening along hinges 8. Due to the pressures contained within the system and the overall size of the opening quarter shells 6*a* and 6*b*, the quarter shells are actuated from an open to a closed position by two opening hydraulic cylinders 82, one connected between each quarter shell and frame 84 of the invention. Each of hydraulic cylinders 82 are of standard design, well known to the art, connected to an external hydraulic control source (not shown) for actuating the cylinder reciprocally between a closed and an open state. The hydraulic cylinders actuate the quarter shells 6*a* and 6*b*, pivoting on hinges 8, which connect the quarter shells 6*a* and 6*b* to the back semi-cylindrical section 4.

The opening of the high pressure container 2 exposes inner pressure container 10. Container 10 comprises a rear semi-cylinder 12 rigidly mounted within back semi-cylinder 4 and two quarter shell front pieces 14 pivoting on inner hinges (not shown). Each of the quarter shells 14 is connected for opening with quarter shells 6*a* and 6*b*, and are opened and closed by the opening and closing action of the front opening quarter shells 6*a* and 6*b*. Within the interior of inner pressure container 10 is found a sealer liner 16, which is a coating of a flexible, gas resistant, flexible sealing material. This material may either be a rubberized compound or any of the oil resistant plastics. At the opening edges of the quarter shells 14, including the section adjacent the inner hinges, which pivotally mate with the rear semi-cylinder 12, and along the corresponding edges of the rear semi-cylinder 12 where the seal liner 16 is broken, are found seal liner interlock faces 18 moulded into the seal liner 16. Faces 18, which form a repeated, sinuously curved finger and joint section are constructed so as to interlock upon closure of the quarter shell sections 14, providing an extended leak resisting path against the passage of pressurized gases. Likewise, the inner pressure container 10, along the joints formed between the rear semi-cylinder 12 and the quarter shells 14 is formed in the pattern of a zig zag interlock 20 designed to provide a further convoluted closure between the closed edges of the sections of the inner pressure container 10, resisting the leakage of gas and liquid.

Figure 4:
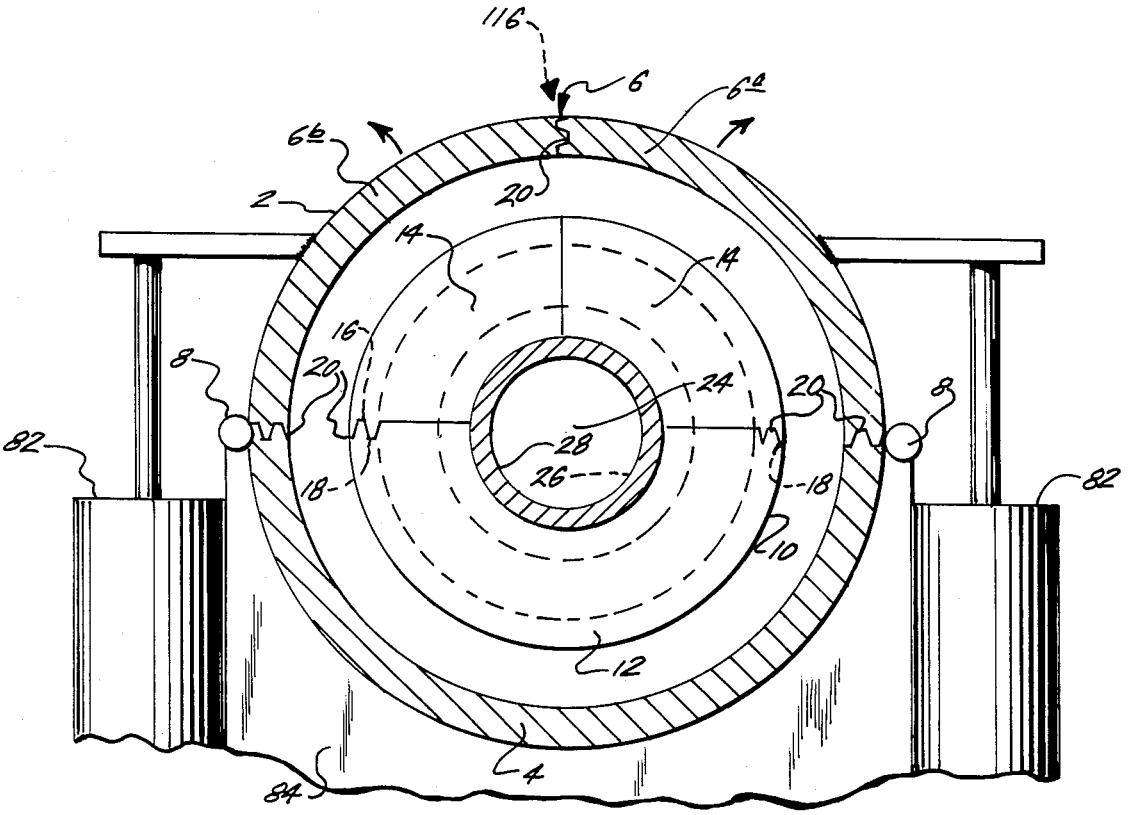
FIG. 4 is a plan, cross-sectional, partially schematic view of a pressure container in accordance with the present invention.

Openings are provided within the inner pressure container 10 for passage of the drill string joint section; these openings are upper pipe passage 24 and lower pipe passage 26 (FIGS. 1 and 4). Within and adjacent to each of the upper pipe passage 24 and the lower pipe passage 26 the seal liner 16 is thickened to form an angled pipe passage seal 28. Angled pipe passage seal 28 in turn is reinforced with angled reinforcement section 29 (FIG. 1), in the shape of an embedded flanged pipe section providing a disc face adjacent the drill string and perpendicular to the longitudinal axis of the drill string, and an annular pipe face circumferentially enclosing a portion of the drill string. In cross section, reinforcement 29 is seen to form an angled reinforcement resisting the tendency of internal pressure to extrude the angled pipe passage seal 28 outward through upper pipe passage 24 and lower pipe passage 26 under the influence of extreme pressure.

The rear of the inner pressure container 10 is provided with three fluid passage openings: upper fluid passage 30, mid fluid bleed passage 32, and lower fluid bleed passage 34. Each of these passages is adapted for a chicksan line 38 by means of a reinforcement plate 40 which clamps sealer liner 16 so as to prevent both seal extrusion and seal lifting under extreme pressures. Chicksan passage 38 is adapted to provide for the mating adaption of a chicksan flange and fasteners (not shown), all as part of the intersection of a chicksan line 44.

Chicksan line 44 is a telescoping, high pressure line having an inner rigid telescoping tube 46 encompassed with an outer rigid telescoping tube 48. Double tapered seals (not shown) on the inner telescoping tube 46 mate with outer tapered seals (not shown) within the outer telescoping tube 48 so as to provide a locked, pressure resisting seal when the chicksan line 44 is either in its fully extended or in its fully closed position. It is to be noted that this design of chicksan line 44 is pressure tight only in the two extreme positions of fully compressed or fully extended.

Beneath the inner pressure container 10, which is within the high pressure container 2, are found lower backup tongs 50 for grasping lower drill string section 104 rigidly and firmly against rotation when the inner pressure container 2 is closed. Conventional slips (not shown and forming no part of the present invention) are provided in oil rig 68 to prevent downward vertical motion of drill string section 104 relative to oil rig 68.

The entire high pressure container 2 rides upon container rollers supported on extended T-bar cross section rails 56. Rails 56 have an upper "T" shaped cross section upon which ride mating pairs of upper rollers 58 and inverted-lower rollers 60. This dual roller construction on the T-bar rails 56 support the high pressure container 2 for rolling both under the normal downward effects of gravity, as well as any upward motion due to an attempted vertical extension of the drill string joint section.

As noted previously, chicksan lines 44 emanating from chicksan passages 38 within an inner pressure container 10 pass through the rear of high pressure container 2 and connect with base plate 84 by means of chicksan flange connections (not shown). Base plate 84 contains lines (not shown) for draining off the fluids from the three fluid passages 30, 32 and 34. Base plate 84 also defines the withdrawn position of high pressure container 2, which is the position high pressure container 2 is in when chicksan lines 44 are fully telescoped to a closed position. Base plate container 84 is located upon oil rig 68 so that when chicksan lines 44 are fully extended, high pressure container 2 is so located that it will encompass the drill string joint section as it issues from the revolving table 108 in oil rig 68.

Affixed above high pressure container 2, in a manner to be described, are found hydraulic tongs 70. Hydraulic tongs 70 are of a standard design, connected to an external hydraulic control means of standard design (not shown). Hydraulic tongs 70, as is well known, are designed for applying torque to upper drill string section 102 when lower drill string section 104 is fixed in position by slips 50. Since the invention is intended to support and manipulate upper drill string section 102 during conditions including possible upward kicks due to over pressure, tong leveler mechanism 72 is provided to maintain hydraulic tongs 70 at an appropriate angle to upper drill string section 102, during vertical motion of upper drill string section 102 with respect to high pressure container 2. Tong levelers 72 comprise tong guides 78 for guiding the hydraulic tongs 70 during small vertical motions, tong guides 78 are vertical pins upon which tongs 70 are mounted for vertical slippage. Hydraulic tongs 70 are further supported by pneumatic telescoping section 74. In turn, pneumatic telescoping section 74 is connected by a pressure line 76 to the interior of inner pressure connecting 10. The overall construction of telescoping tube 74 and pressure lines 76 are such that when a pressure kick occurs within inner pressure container 10 causing the vertical motion of pipe 102, the pressure is equally transmitted through pressure lines 76 to telescoping tube 74 which provides a corresponding vertical motion to the hydraulic tongs 70.

The upper motion of drill pipe 102 is restrained by top slip and carrier assembly 90. Top slip and carrier assembly 90 comprises a plurality of slip jaws 92 enclosed within clamping container 94, which in turn is in two half sections within high pressure container 2 and above inner pressure container 10. The clamping container 94 is constructed so that when high pressure container 2 is closed, the two halves are enclosed about upper drill string section 102. When high pressure container 2 is opened, the two halves of clamping container 94 open thereby causing slip jaws 92 to release upper drill string section 102. Annularly around the outer periphery of clamping container 94 are found annular drive gear 96 and upper and lower annular roller bearings 98 supporting the clamping container means 94 for rotation within the high pressure container 2. Upper and lower thrust bearings 99 support clamping container 94 within high pressure container 2 against significant vertical movement.

Gearbox assembly 110 links hydraulic tongs 70 for driving means through sliding spline 112 and through a plurality of gears comprising gearbox assembly 110 to the annular drive gear 96 of clamping container 94. Gearbox assembly 110 is designed and synchronized so that when hydraulic tongs 70 are rotated to a position for permitting the opening of hydraulic tongs 70, clamping container means 94 is rotated to a position so that the two halves will open with the opening of hydraulic pressure container 2. Thus gearbox assembly 110 is designed to establish a one to one rotation rate between clamping container means 94 and hydraulic tongs 70.

In addition, hydraulic pressure sensing means (not shown) is interconnected between high pressure container 2 and clamping container means 94, providing thereby an indication of the torque applied to upper drill string section 102 with respect to the fixed lower drill string section 104 clamped within high pressure container 2.

Figure 3:
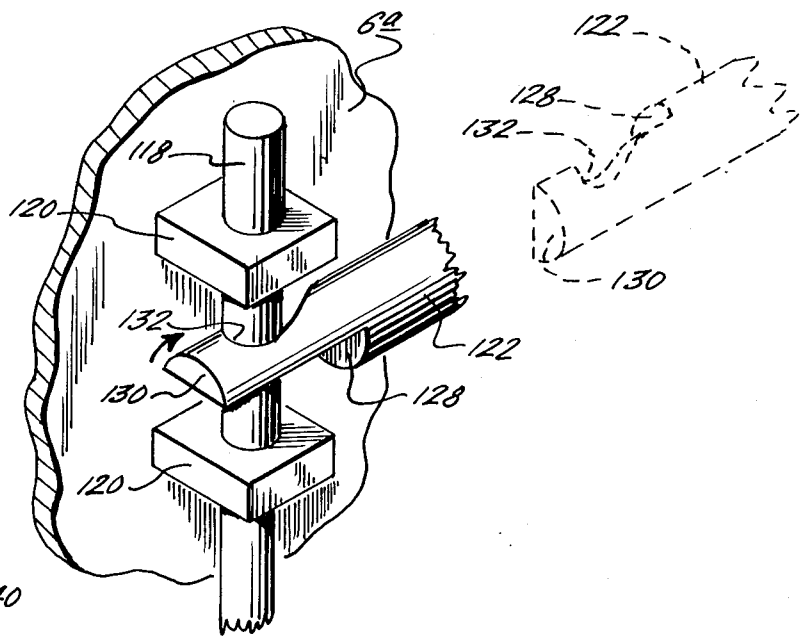
FIG. 3 is a detailed view of portions of the locking mechanism illustrated in FIG. 2.
Figure 2:
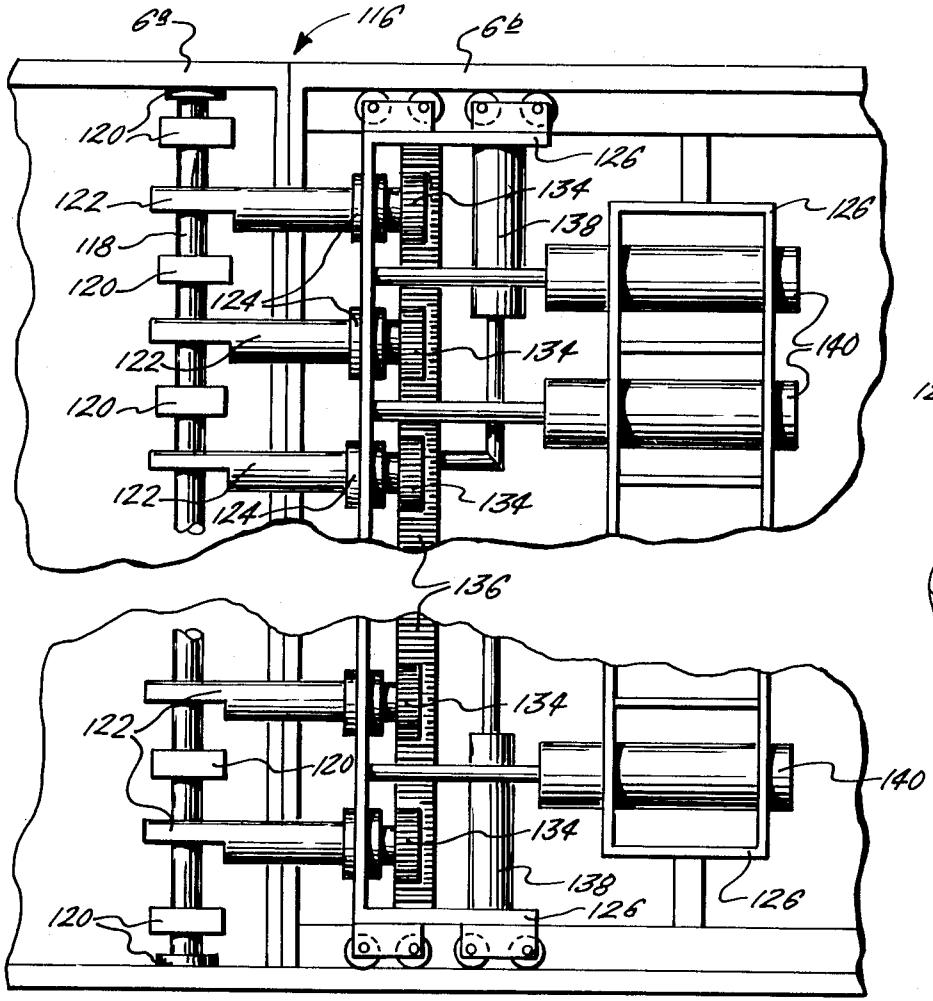
FIG. 2 is a perspective view of a locking mechanism in accordance with the present invention.

Along the line at which the front opening quarter shells **6*a* and 6*b* of high pressure container 2 meet, pressure resisting locking means 116 (FIG. 2) is found disposed, to lock together against pressure expansion of front opening quarter shells 6*a* and 6*b*. Locking means 116 comprise first, a vertically disclosed locking bar 118 supported by a plurality of bar brace attachments 120 to a first front opening quarter shell 6*a* (FIGS. 2 and 3**).

Mounted to the second quarter shell **6*b*, along a line parallel to, in cooperating relationship with locking bar 118 are found a plurality of rotating cylinder locking members 122. Each of rotating cylinder locking members 122 is supported for rotation within a thrust bearing 124, all of which are mounted in turn within lock support 126. The rotating cylinder lock members 122 are provided in round cross section with half diameter cut away 128, forming a semi circular grasping section 130 (FIG. 3); within semi-circular section 130 is provided hook opening 132. On the end of each rotating cylinder lock 122 opposite semi-circular section 130 is cylinder pinion gear 134 (FIG. 2), circumferentially disposed upon locking cylinder 122, adapted for rotating locking cylinder 122 within thrust bearing 124. All of the cylinder pinions 134 mate with lock actuating rack 136, which rack extends against and engages all pinions 134 of all locking cylinders 122 within locking means 116. At least one and preferably two rack actuators 138 are installed upon lock support 126 for actuating locking rack 136 reciprocally within guide means provided on lock support 126. The rack guide means preferably are tongue and groove supports within lock support 126 for providing a smooth sliding motion of locking rack 136 reciprocally along lock support 126 in response to the movement of rack actuators 138. In turn, lock support 126 is supportably and fixably attached to the second quarter shell member 6*b* by a plurality of lock support actuators 140. In the preferred embodiment of the invention, lock supporting actuators 140, as well as rack actuators 138, are in the form of hydraulic pistons. Lock supporting actuators 140 are therefore hydraulic pistons fixedly attached on a first end to quarter shell 6*b* and on a second end to lock support 126. Hydraulic fluid is provided to the hydraulic pistons of lock support actuator 140** by standard hydraulic piping means (not shown), controlled and pressurized by standard hydraulic fluid controls well known to the art and not shown for clarity.

In operation, high pressure container 2 is found in a stowed position adjacent base plate 84, the position established by the retracted position of chicksan lines 44. Chicksan lines 44, as stated, are constructed at a length such that high pressure container 2 may be rolled along oil rig 68 by means of container rollers 58 and 60 to an extended position, defined by the fully extended position of chicksan lines 44, at which point high pressure container 2 encompasses the drill string joint section.

When it is desired to withdraw and break apart the drill string, high pressure container 2 is transitioned to the extended state, the front opening quarter shells **6*a* and 6*b* having been opened by actuation of hydraulic cylinders 82 (FIG. 4). The opening of quarter shells 6*a* and 6*b* upon hinges 8 in turn opens inner pressure container 10 by opening quarter shell sections 14** upon their respective hinges.

When pressure container 2 has been extended along container rollers 58 and 60 so as to encompass the drill string joint section, hydraulic cyllindres 82 are actuated so as to close quarter shell 6 thereby enclosing drill string section 100 within inner pressure container 10.

High pressure container 2 is then locked by extending lock support actuators 140 (FIG. 2) so as to move lock support 126 in a direction towards and adjacent to locking bar 118. In the initial unlocked condition, rotating cylinder locking members 122 are positioned such that the half diameter cut away section 128 is spaced from locking bar 118 and moves past locking bar 118, without touching same. At this point, rack actuators 138 are activated, transitioning locking rack 136 from a first to a second position. This in turn rotates mating cylinder pinion gear 134, rotating cylinders 122 within thrust bearings 124. A one quarter rotation of rotating cylinders 122 serves to rotate the open hook section 132 of the half diameter cut away 128 to encompass locking bar 118. Locking support actuators 140 are then retracted forcibly, causing each of the hook sections 132 of the rotating cylinders 122 to catch and engage locking bar 118. This forms a repeated, mechanically strong lock, closing container 2 and thus inner pressure container 10 against substantial pressure.

Hydraulic tongs 70 (FIG. 1) are then closed around upper drill string section 102. Lower backup tongs 50 previously have graspingly enclosed lower drill string section 104 by the closure and locking of hydraulic pressure container 2.

Hydraulic tongs 70 are then actuated, in a manner understood in the art, to unfasten upper drillstring section 102 from lower drill string section 104. Since the unfastened joint 106 is a standard API pin and socket joint, the unscrewing effect imparts a vertical motion, equivalent to the API thread pitch, to upper drill string section 102. There is therefore provided within the container means 94 which are firmly clamped through slip jaws 92 to upper drill string section 102, sufficient vertical tolerance within the roller bearings 98 and the thrust bearings 99 to permit vertical motion so that the upper drill string section 102 may be unfastened and fully retracted from lower section 104.

If significant pressure is trapped within the drill string joint section, the unfastening of joint 106 in the aforementioned manner will proceed to a point at which the entrapped pressure exceeds the retaining strength of the remaining engaged threads within joint 106, at which point upper section 102 will be forcibly ejected in a vertical direction from lower drill section 104. Since clamping container means 94 has an internal tolerance to permit some vertical motion, this will result in a sudden upward vertical kick until thrust bearings 99 engage within high pressure container 2. The overall clamping force of slip jaws 92 on upper drill section 102 and the substantial construction of clamping container means 94 stop further vertical motion of the drill string section 102. The simultaneous release of pressure within inner pressure container 10 is transmitted by means of pressure lines 76 to telescoping tube 74 thereby kicking hydraulic tongs 70 along tong guide 78 in a vertical motion equivalent to the vertical motion of the clamping container means 94. Since the total vertical motion of clamping container means 94 is a pre-designed amount, designed to permit vertical motion for the unscrewing of joint 106, telescoping tube 74 need only be designed for a fixed upward motion of an equal amount.

This action of tong leveler assembly 72 prevents the upward kick on upper pipe section 102 from suddenly twisting hydraulic tong 70 about upper drill string section 102 thus preventing significant damage that might otherwise result due to the significant mass and inertia of hydraulic tong 70.

At this point, the trapped pressure and any trapped fluids within drill pipe sections 102 have been released into the inner pressure container 10. The flexible sealing action provided by seal liner 16 both along the seal interlocks 18 (FIG. 4) and shell interlocks 20 and along the angled pipe passage seals 28 prevents any escape of the pressure from inner pressure container 10. The trapped gaseous pressure is then released by means of valves provided within base plate 84 along mid fluid bleed chicksan 32. Any trapped fluids within inner pressure container 10 will fall to the bottom of the interior of inner pressure container 10 and can therefore be drained off by lower fluid bleed chicksan 34. It is also possible that trapped particulate matter such as drill cuttings or sand will be released during this process to the interior inner pressure container 10. Once inner pressure container 10 has been bled to ambient pressure through mid chicksan 32, a washing fluid may be injected through upper fluid line 30, which in the preferred embodiment is angled so as to permit spray of an injected fluid into the general vicinity of joint 106. This spray serves to fluidize and wash any solids or particulates released from upper section 102 and permit their removal as a fluid slurry through lower fluid bleed chicksan 34.

At this point, upper drill string section 102 having been separated from lower drill string section 104, and all pressures and fluids having been bled off, the engagement of locking means 116 is reversed by extending locks actuators 140 (FIG. 2) so as to extend and release locking bar 118 from hooks 132 (FIG. 3), and then rack actuators 138 are actuated to rotate rotating cylinders 122 so as to rotate half diameter cut away 128 and hooks 132 free of locking bar 118. At this point, the locking means 116 (FIG. 2) having been released, opening hydraulic cylinder 82 (FIG. 4) is actuated, opening quarter shells **6*a* and 6*b* and inner pressure container quarter shells 14, permitting the removal of upper drill string section 102 (FIG. 1). The traveling block then engages lower drill string section 104 which is raised to become a second upper drill string section 102 and to expose a second joint 106 for opening. The process as described above is then repeated for each of the joints 106** until the entire drill or tubing string has been broken down.

It will be apparent from the above description that the overall invention thus aids in the unfastening of drill or tubing string sections during the breakdown of a drill string while containing any release of either fluids or pressurized gasses for controlled removal via the provided chicksan lines. Means are also provided for permitting the wash down of any released solids trapped in any of the drill string sections.

As a result, operating personnel such as roughnecks on oil rig 68 are protected from exposure to any sudden release of entrapped gases or fluids as well as from the effect of any sudden kickfree of any unrestrained drill pipe section. The overall safety of operations on the drill floor is considerably enhanced. Furthermore, inasmuch as the invention is coupled to restraints and actuates the hydraulic tongs, the chances of injury from the operation of the tongs and the lower slips are essentially eliminated. Since hydraulic tongs are the single most injury producing apparatus on an oil rig floor, this in itself is a significant increase in safety.

It should be apparent that in addition to the specific preferred embodiment described above, the invention is susceptible of several variances and thus the scope of the invention actually claimed is that in the claims, rather than being restricted to the one specific embodiment discussed above.

I claim:

1. An apparatus for use within an oil well rig for decoupling a tubing string into a plurality of pipe segments comprising, in combination:

rotary tong means for applying an unthreading torque to a first, upper pipe segment within the tubing string;

torque resisting means for securing a second, lower pipe segment within the tubing string against said unthreading torque;

containing means, intermediate said rotary tong means and said torque resisting means, enclosing a threaded joint of said tubing string, adapted for containing pressurized gases, liquids, and particulates, released from said threaded joint upon said decoupling;

fluid communicating means for allowing fluid communication between said containing means and a receiving point adapted for receiving said pressurized gases, liquids, and particulates;

means for moving said rotary tong means, said torque resisting means and said containing means between a closed, engaging position with the tubing string and an open position; and means for horizontally moving said rotary tong means, said torque resisting means and said containing means between a position adjacent said tubing string and a position away from said tubing string.

2. The apparatus as described in claim 1 above, further comprising:

upkick means intermediate said rotary tong means and said torque resisting means for securing said first, upper pipe segment against sudden upward movement.

3. An apparatus for use within an oil well rig for decoupling a tubing string into a plurality of pipe segments comprising, in combination:

rotary tong means for applying an unthreading torque to a first, upper pipe segment within the tubing string;

torque resisting means for securing a second, lower pipe segment within the tubing string against said unthreading torque;

containing means, intermediate said rotary tong means and said torque resisting means, enclosing a threaded joint of said tubing string, adapted for containing pressurized gases, liquids, and particulates, released from said threaded joint upon said decoupling;

fluid communicating means for allowing fluid communication between said containing means and a receiving point adapted for receiving said pressurized gases, liquids, and particulates; and upkick means intermediate said rotary tong means and said torque resisting means for securing said first, upper pipe segment against sudden upward movement, said upkick means comprising:

a plurality of jaws adapted for clamping said upper pipe segment against vertical movement;

rotary drive means adapted for clamping said jaws against said upper pipe segment and adapted for rotating said jaws about a longitudinal axis of said upper pipe segment;

synchronizing means, synchronizing rotation of said rotary tong means with rotation of said rotary drive means for rotating said jaws, adapted to provide synchronous rotation of said jaws with said rotary tong means; and vertical movement means, responsive to vertical movement of said upper pipe segment, further responsive to sudden pressure surges within said containing means, adapted for moving said rotary tong means synchronously with said upper pipe segment so as to preserve relative orientation of said rotary tong means and said upper pipe segment during operation.

4. An apparatus for use within an oil well rig for decoupling a tubing string into a plurality of pipe segments comprising, in combination:

rotary tong means for applying an unthreading torque to a first, upper pipe segment within the tubing string;

torque resisting means for securing a second, lower pipe segment within the tubing string against said unthreading torque;

containing means, intermediate said rotary tong means and said torque resisting means, enclosing a threaded joint of said tubing string, adapted for containing pressurized gases, liquids, and particulates, released from said threaded joint upon said decoupling; and fluid communicating means for allowing fluid communication between said containing means and a receiving point adapted for receiving said pressurized gases, liquids, and particulates;

said containing means comprising:

a first, inner pressure chamber, having a first open position adapted for receivingly encompassing said threaded joint and a second closed position adapted for enclosing said threaded joint, thereby forming a lower and an upper circular tubing string passage therethrough;

a first, lower split inverted bevel seal means, enclosing said tubing string adjacent said lower tubing string passage, said lower bevel seal means further being thicker adjacent said lower tubing string passage, tapering to a thinner section at a point removed from said lower tubing string passage;

a second, upper split inverted bevel seal means, enclosing said tubing string adjacent said upper tubing string passage, said upper bevel seal means further being thicker adjacent said upper tubing string passage, tapering to a thinner section at a point removed from said upper tubing string passage;

a second, cylindrical outer pressure chamber, supportingly enclosing said first pressure chamber;

latching means for closing said second, outer pressure chamber against internal pressure; and means for controllably opening and closing said second outer chamber.

5. The apparatus as described in claim 4 above, further comprising:

upkick means intermediate said rotary tong means and said torque resisting means for securing said first, upper pipe segment against sudden upward movement, said upkick means comprising:

a plurality of jaws adapted for clamping said upper pipe segment against vertical movement;

rotary drive means adapted for clamping said jaws against said upper pipe segment and adapted for rotating said jaws about a longitudinal axis of said upper pipe segment; and synchronizing means, synchronizing rotation of said rotary tong means with rotation of said rotary drive means for rotating said jaws, adapted for providing synchronous rotation of said jaws with said rotary tong means, wherein:

said upkick means and said synchronizing means are substantially contained within said outer chamber.

6. The apparatus as described in claim 4 above, further comprising:

a. at least one pressure resistant fluid communicating line communicating between inside of said inner pressure chamber and said receiving point.

7. The apparatus as described in claim 4 above, wherein said fluid communicating means comprises:

a. a first pressure resistant fluid line for allowing communication of said liquids and particulates between said inner pressure chamber and said receiving point;

b. a second pressure resistant fluid line for allowing communication of said pressurized gases between said inner pressure chamber and said receiving point; and c. a third pressure resistant fluid line, for allowing a fluid flow for washing to enter said inner pressure chamber from a point exterior to said apparatus, adapted for directing said fluid flow onto said threaded joint, wherein said second fluid line is positioned intermediate said first and said third fluid lines.

8. The apparatus as described in claim 4 above, further comprising:

an enclosed, angled, rigid deformation-resisting member, imbedded within said beveled seal means, having a first, cylindrical member radially parallel to a longitudinal axis of said tubing string, and having a second, disk, member radially perpendicular to the longitudinal axis of said tubing string.

9. The apparatus as described in claim 4 above, wherein said latching means further comprise:

a bar member rigidly affixed to a first chamber member to be latched;

at least one hook clampingly attached to a second chamber member to be latched, adapted for rotary motion about a rotary axis, further adapted for lateral motion along said rotary axis;

means for rotating said hook member around said rotary axis from a first position wherein the rotary axis of said hook member does not intersect said bar member to a second position wherein the rotary axis of said hook member substantially intersects said bar member; and means for forcibly moving said hook member laterally along the rotary axis, engaging said hook member, rotated to said second rotary position, securingly against said bar.

10. The apparatus as described in claim 4 above, wherein said first, inner pressure chamber further comprises:

an inner, flexible seal member;

an outer, rigid, pressure resisting member, fixedly bonded to said inner seal member;

said inner and outer members forming:

a rigid, half cylindrical back portion;

a first and a second quarter cylindrical portion, hingedly attached to said back portion for opening and closing, forming cooperatively when closed a closed cylindrical structure; pressure interlock mating means along edges of contact of said half cylindrical back portion and said first and said second quarter cylindrical portions when closed.

11. The apparatus as described in claim 10 above, wherein said interlock mating means further comprise:

along a first, contacting edge, a plurality of ridges, extending parallel to said first edge, substantially orthogonal to a flow of differential pressure across said first edge;

along a second, mating edge, a plurality of ridges extending parallel to said second edge, substantially orthogonal to a flow of pressure differential across said second edge;

said ridges along said first and said second edge being further adapted for interdigitated contacting engagement when said inner pressure chamber is closed.

* * * * *